United States Patent [19]

Barbulla

[11] Patent Number: 4,638,518

[45] Date of Patent: Jan. 27, 1987

[54] WATER BED MATTRESS

[76] Inventor: Winfried P. Barbulla, Bregneveien 22, N-1825 Tomter, Norway

[21] Appl. No.: 805,422

[22] Filed: Dec. 4, 1985

[30] Foreign Application Priority Data

Dec. 17, 1984 [NO] Norway ..... 845056

[51] Int. Cl.[4] ..... A47C 27/10

[52] U.S. Cl. ..... 5/452; 5/450; 5/451

[58] Field of Search ..... 5/451, 452, 455, 450, 5/449, 457, 422

[56] References Cited

U.S. PATENT DOCUMENTS

| | | | |
|---|---|---|---|
| 3,585,356 | 6/1971 | Hall | 5/451 |
| 3,748,669 | 7/1973 | Warner | 5/451 |
| 3,803,647 | 4/1974 | Reswick | 5/451 |
| 3,842,455 | 10/1974 | Whitney | 5/452 |
| 4,079,473 | 3/1978 | Phillips | 5/452 |
| 4,168,555 | 9/1979 | Benjamin | 5/451 |
| 4,192,031 | 3/1980 | Fogel | 5/451 |
| 4,247,962 | 2/1981 | Hall | 5/450 |
| 4,411,033 | 10/1983 | Morgan | 5/451 |
| 4,558,476 | 12/1985 | Linder | 5/451 |

*Primary Examiner*—Alexander Grosz

*Attorney, Agent, or Firm*—Mason, Fenwick & Lawrence

[57] ABSTRACT

A water bed mattress made of a water proof, flexible material that has tensile strength, comprising at least three chambers provided with valves, one chamber being divided into an upper and a lower chamber portion, said lower chamber portion being filled with water and particulate buoyancy material, e.g. polystyrene particles that are immersed in water, and said upper chamber portion being filled with water. The other chambers are filled with air and comprise air chambers provided at each longitudinal side of said mattress for stiffening its lateral edges, and adjustment chambers provided at the bottom of said mattress and provided with a common valve for adjustment of the pressure in said water bed mattress. Furthermore, central chambers are provided at the bottom of said mattress between said adjustment chambers. Said air chambers are always filled with air to absorb loads in case of sagging when the top surface of said water bed mattress is subjected to an excessive punctiform load on the upper surface of said water bed mattress. The intermediate bottom is secured to the bottom portion of said mattress and is arched upwards in breadth as well as in the longitudinal direction in an un-loaded state. This results in a water bed mattress having a small volume of water, since this is partly replaced by said air chambers and the particulate buoyancy material.

7 Claims, 6 Drawing Figures

WATER BED MATTRESS

Figure 1:
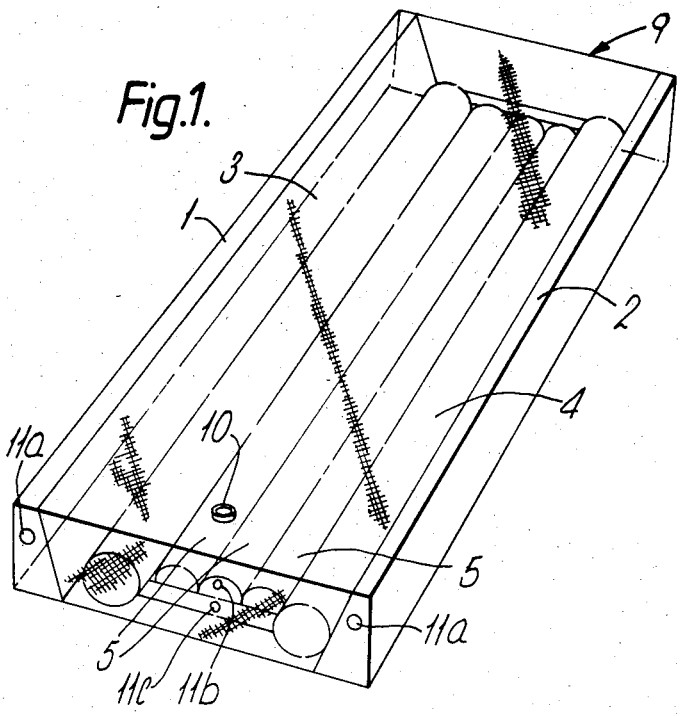

The present invention relates to a water bed mattress of the kind as stated in the introductory part of the following independent claim 1, said mattress being very light weight and adjustable as regards hardness and wave dampening as well as not requiring a specially constructed bed but being adapted for most beds that are used today.

Water beds have been used for many years and their advantages are well-known and recognized. Previously, water beds were primarily used for medical purposes, but recently they also found a market as sleeping furniture in private homes. The above mentioned kind is meant for the latter area of application.

In their traditional form water beds comprise a flexible container or bag that is filled with water and constitutes a mattress that is placed in a bed foundation comprising side members, end members, and a bottom. Said containers constitute the mattress upon which the user is to lie.

Water depth in such a mattress is 20–24 cm representing a total weight of 800–1000 kg. Due to this fact a specially constructed bed foundation is required which in case of a leakage represents a hazard of extensive water damage. Adjustment of the extent of wave dampening causes inconvenience in draining off or filling up water in the mattress. Additionally, water mattresses enabling wave dampening to a larger extent are more expensive. Said kind of water bed mattress is not stable when subjected to a load. When such a mattress is subjected to a load at an edge, e.g. if the user sits or lies on the edge, as well as when the user sits in the middle of said mattress it will sag and the user will have contact with the bed bottom.

If two persons in a double bed with a water mattress desire different hardness of their mattresses, different wave dampening or different temperature it will be necessary for them to use two separate water mattresses that are mutually isolated. Until now, this resulted in approximately double cost in comparison with the cost of one double bed water mattress.

The disadvantages of said kind of water bed may be summarized as follows:

Heavy weight.

Hazards of extensive water damages in connection with a possible leakage.

Specially constructed bed foundation necessary, which causes a larger expense than would be the case if an ordinary bed foundation could be used.

Change of the volume of water necessary for adjustment of hardness and/or wave dampening.

Unstable when a user sits in the middle of the mattress, or sits/lies at the edge of it.

Uniform buoyancy only when loaded by the user's body in a lying position.

Requires special transport and mounting.

The large volume of water in the water mattress requires larger amounts of anti-algae remedies and more electric power for heating.

From the published DK Specification No. 133 851 it is known to introduce a large amount of polystyrene particles into a water mattress, said particles floating on top of a smaller volume of water (ratio 4:1). A disadvantage of such an approach is that the polystyrene particles will float on top of the water when the mattress is not loaded and said water mattress must be considerably deformed, i.e. the polystyrene particles must be squeezed down into the water, before full load-carrying capacity is achieved. This means that the dry polystyrene particles floating on top of the water do not act as a buoyancy increasing means and support the load until they have been immersed in the water.

With any movement in the water mattress these dry polystyrene particles will cause a rustling noise, and when they have been moistened due to immersion they will tend to clog or adhere to the inside of the water mattress, sometimes forming agglomerations at the longitudinal sides and at the head and foot ends of the mattress. That means that the polystyrene particles will not float back into a normal unstressed position after removal of the load.

It is an object of the present invention to provide a water mattress where the above mentioned disadvantages are eliminated.

According to the present invention this is achived by the features stated in the characterizing part of the following independent claim 1 and the dependent claims.

Figure 2:
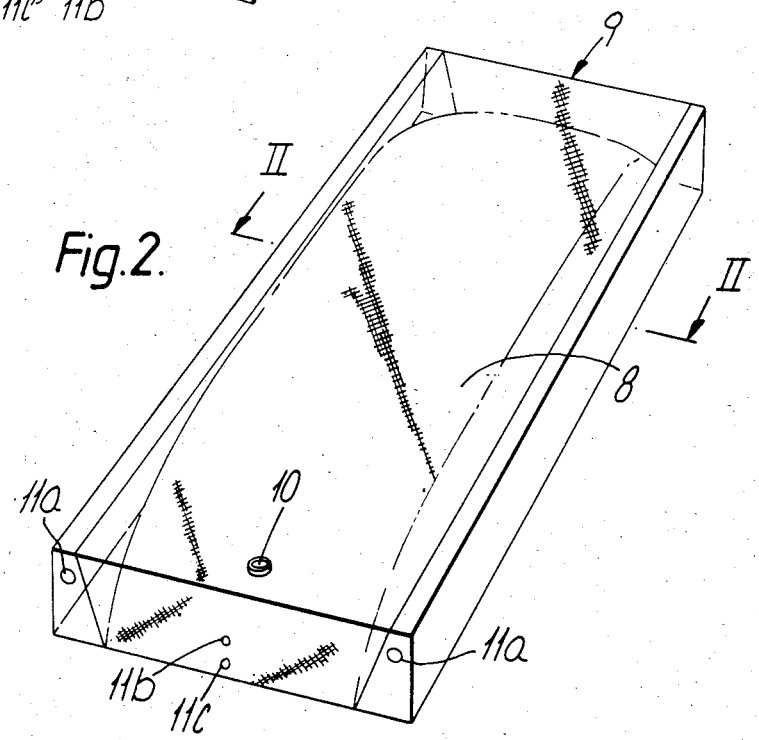
Figure 3:
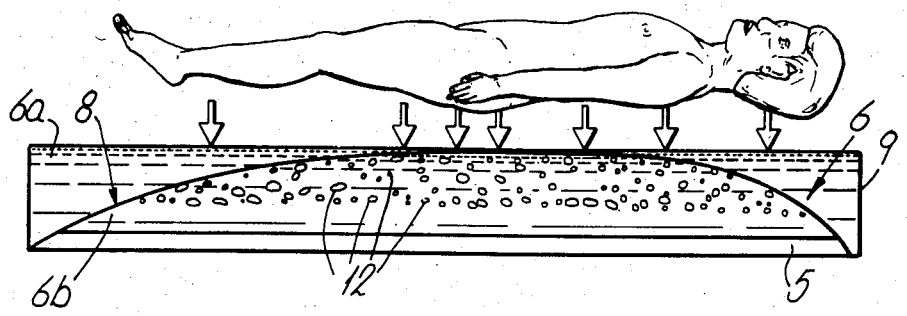
Figure 4:
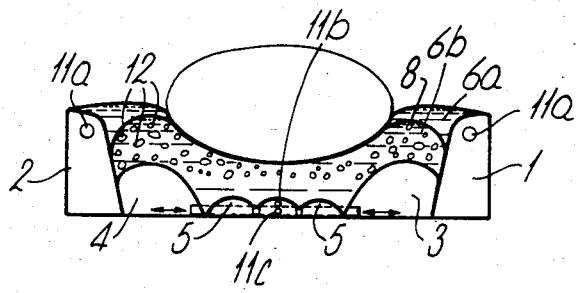
Figure 5:
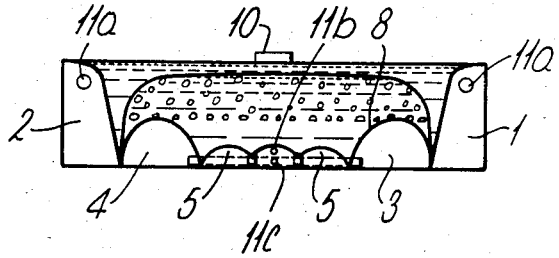
Figure 6:
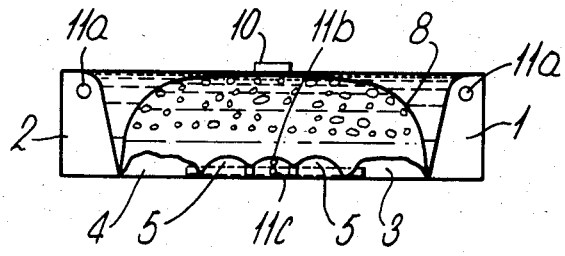

The water mattress according to the present invention will be disclosed in more detail below with reference to the drawing, wherein FIG. 1 is a top view in perspective of the water bed mattress shown with a transparent surface and without any partition wall in order to give a clear view of the air chambers, FIG. 2 corresponds to FIG. 1, showing a transparent surface of the mattress and disclosing a partition wall dividing the water chamber into a lower and an upper chamber portion, FIG. 3 is a longitudinal section of the water bed mattress showing load arrows from a person lying on the mattress, FIG. 4 is a cross section of the water bed mattress in a loaded state, FIG. 5 is a cross section along line II—II in FIG. 2 of the water bed mattress in a non-loaded state, and FIG. 6 corresponds to FIG. 5 apart from the fact that there is a reduced volume in the lower air chambers which makes the water bed mattress softer.

As shown in FIG. 1 the water bed mattress comprises an external mattress bag 9 of a water proof, flexible material showing tensile strength. In said mattress bag two air chambers 1 and 2 are provided extending along each side of the mattress bag, and between said air chambers further air chambers 3 and 4 are provided as well as one or more air chambers 5 between the last mentioned chambers, if that is desired. Said air chambers 3, 4, and 5 are secured to the bottom of said mattress bag and are preferably, additionally, secured to the elongate lateral air chambers 1 and 2. In an inflated state all air chambers 1, 2. 3, 4, and 5 will, thus, contribute to distend said mattress bag 9 into a substantially parallelepipedic body. Said elongated lateral chambers 1 and 2 are provided with a valve 11*a* each, and the intermediate air chambers 3 and 4, which are arranged in mutual communication, are provided with a common valve 11*c*.

The central air chambers 5 also communicating mutually are provided with a common valve 11*b*. Said mattress bag 9 and said air chambers 1, 2, 3, 4, and 5 inside it border a chamber 6 intended for filling with a liquid through a liquid filling valve 10 provided in the mattress top. Water chamber 6 is partitioned into two chamber portions, i.e. an upper chamber portion 6*a* and a lower chamber portion 6*b*, by a partition wall 8 as shown in FIG. 2 and also called an intermediate bottom. Said intermediate bottom 8 consists of a flexible material showing tensile strength that may also be water proof. In this case said lower chamber portion 6*b* is provided with a separate water filling valve (not shown). Said chamber portions 6*a*, 6*b* are filled with water and the lower chamber portion 6*b* is also, partly, filled with buoyancy particles, e.g. in the form of polysyrene particles 12 that are immersed in water and urge said intermediate bottom 8 upwards because of their buoyancy. Said intermediate bottom 8 is secured to the bottom 9 of said mattress bag. If desired, said bottom is secured to the lateral air chambers 1, 2, or to the adjacent air chambers 3, 4, and it is shaped so as to show an arcuation upwards in breadth as well as in the longitudinal direction. As shown in FIG. 3, the longitudinal arc of the intermediate bottom 8 is steeper at the head end of the water bed mattress than at its foot end in a non-loaded state. Said intermediate bottom 8 may be provided with openings for passage of water and it may, if desired, consist of a net having smaller meshes than the buoyancy particles.

In the above disclosed water bed mattress the air filled lateral chambers 1, 2 will stiffen the mattress edges in an inflated state. Since they are provided with separate valves ll*a*, ll*a*, they are independently adjustable. Thus, the free sitting edge, e.g. as represented by lateral chamber 1, in a case where two water bed mattresses are used in a double bed, may be harder than side chamber 2, the latter, thus, forming a soft transition to the adjacent water bed mattress. In such a double bed the lateral chambers 1, 2 of each water mattress facing each other will act as a heat barrier. Thus, the temperature in each of the water bed mattresses can be adjusted independently by the aid of a heating element (not shown) in each mattress. Air chambers 5, also called bottom chambers, between chambers 3 and 4, also called adjustment chambers and arranged at the bottom of the mattress, should always be inflated when the water bed mattress is used. In this manner the above mentioned sagging is reduced and the necessary volume of water as well as the amount of added buoyancy material 12 in the water bed mattress are reduced. Said adjustment chambers 3 and 4 are inflated after chamber 6 has been filled with water and buoyancy material, i.e. the lower chamber portion 6*b* is filled with water and buoyancy material in a desired ratio, and the upper chamber portion 6*a* is filled with water. By increasing or reducing the volume of the adjustment chambers 3, 4 the liquid pressure in chamber 6 comprising the upper chamber portion 6*a* and the lower chamber portion 6*b*, is adjusted. Thus, an adjustment of the hardness of the water bed mattress is achieved. An increase of pressure will also have a wave dampening effect. Due to the division of chamber 6 with partition wall 8 it is possible, as will appear from the above mentioned, that chamber portions 6*a*, 6*b* are filled with a filling material of different density, i.e. the resulting density of the mixture of water and buoyancy particles in the lower chamber portion is lower than that of the water in the upper chamber portion 6*a*. The particulate buoyancy material will be kept in place in the lower chamber portion 6*b* by the aid of the intermediate bottom 8 preventing said material from floating up into upper chamber portion 6*a*. The intermediate bottom 8 being shaped an asymmetric bulge is formed which collects the buoyancy material 12 and causes a bias of the intermediate bottom 8 in the areas that are subjected to most loading in use, as appears from FIG. 3, where the load arrows from the delineated person are concentrated on top of the asymmetric bulge of the intermediate bottom 8. When the upper surface of the mattress bag 9 is loaded and impressed to contact with the intermediate bottom 8, as shown in FIG. 4, the buoyancy material 12 will be pushed to the sides and together with the water it will support the body with an upward pressure corresponding to the body load. This means that the heaviest parts of the body will sink deeper than the light parts and, thus, a comfortable and straight position of rest is achieved.

Having described my invention, I claim:

1. A water bed mattress made from a waterproof, flexible material having tensile strength, provided with at least three chambers with valves, one chamber of which contains water, and a particulate material floatable on water and the other chambers containing air, characterized in that said chamber containing water and buoyancy particles is bordered on its bottom portion and laterally at least at each longitudinal side by said air chambers and that the water-/buoyancy particle chamber is provided with a flexible partition wall, formed as an intermediate bottom that is secured to the bottom member of said mattress and is arcuate upwards in breadth as well as the longitudinal direction in a non-loaded state, resulting in an upper and a lower chamber portion, said lower chamber being filled with water and buoyancy particles immersed in the water and said upper chamber portion being filled with water, said intermediate bottom adapted to retain said buoyancy particles in said lower chamber and, the longitudinal arch of the intermediate bottom being more steeply arched at the head of said water bed mattress than at its foot end in a non-loaded state.

2. A water bed mattress as claimed in claim 1, characterized in that said intermediate bottom is provided with openings for the passage of water.

3. A water bed mattress as claimed in claim 1, characterized in that said intermediate bottom constitutes a net.

4. A water bed mattress as claimed in claim 1, characterized in that part of the buoyancy material, is encased and attached to said intermediate bottom.

5. A water bed mattress as claimed in claim 1, characterized in that the air chambers comprise two longitudinal lateral chambers provided with a valve each and having a height that corresponds to the height of said mattress, and at least two intermediate, mutually communicating chambers which are provided at the bottom of said mattress.

6. A water bed mattress as claimed in claim 5, characterized in at least two communicating, central chambers have a common valve provided at the bottom of said mattress between said two intermediate mutually communicating chambers.

7. A water bed mattress as claimed in claim 1, characterized in that air chambers, additionally, border the buoyant particle/water chamber at the head end and foot end of said mattress.

* * * * *